US008657646B2

(12) United States Patent
Benvegnu et al.

(10) Patent No.: US 8,657,646 B2
(45) Date of Patent: Feb. 25, 2014

(54) ENDPOINT DETECTION USING SPECTRUM FEATURE TRAJECTORIES

(75) Inventors: Dominic J. Benvegnu, La Honda, CA (US); Boguslaw A. Swedek, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 316 days.

(21) Appl. No.: 13/103,868

(22) Filed: May 9, 2011

(65) Prior Publication Data

US 2012/0289124 A1 Nov. 15, 2012

(51) Int. Cl.
*B24B 49/12* (2006.01)

(52) U.S. Cl.
USPC ..... 451/6; 451/41

(58) Field of Classification Search
USPC ..... 451/5–8, 28, 41, 57; 156/345.16
See application file for complete search history.

(56) References Cited

U.S. PATENT DOCUMENTS

| | | | | |
|---|---|---|---|---|
| 5,823,853 | A * | 10/1998 | Bartels et al. | 451/5 |
| 6,071,177 | A * | 6/2000 | Lin et al. | 451/6 |
| 6,106,662 | A * | 8/2000 | Bibby et al. | 156/345.13 |
| 6,111,634 | A * | 8/2000 | Pecen et al. | 356/72 |
| 6,190,234 | B1 * | 2/2001 | Swedek et al. | 451/6 |
| 6,290,572 | B1 * | 9/2001 | Hofmann | 451/5 |
| 6,358,362 | B1 * | 3/2002 | En et al. | 156/345.13 |
| 6,511,363 | B2 * | 1/2003 | Yamane et al. | 451/6 |
| 6,618,130 | B2 * | 9/2003 | Chen | 356/73 |
| 7,018,271 | B2 * | 3/2006 | Wiswesser et al. | 451/8 |
| 7,300,332 | B2 * | 11/2007 | Kobayashi et al. | 451/5 |
| 7,406,394 | B2 * | 7/2008 | Swedek et al. | 702/159 |
| 7,438,627 | B2 * | 10/2008 | Kobayashi et al. | 451/5 |
| 7,645,181 | B2 * | 1/2010 | Kobayashi et al. | 451/5 |
| 7,840,375 | B2 * | 11/2010 | Ravid et al. | 702/172 |
| 8,045,142 | B2 * | 10/2011 | Kimba | 356/72 |
| 8,088,298 | B2 * | 1/2012 | Swedek et al. | 216/84 |
| 8,157,616 | B2 * | 4/2012 | Shimizu et al. | 451/8 |
| 2002/0055192 | A1 | 5/2002 | Redeker et al. | |
| 2003/0207651 | A1 * | 11/2003 | Kim et al. | 451/6 |
| 2005/0026542 | A1 * | 2/2005 | Battal et al. | 451/5 |
| 2005/0042975 | A1 * | 2/2005 | David | 451/5 |
| 2008/0099443 | A1 * | 5/2008 | Benvegnu et al. | 216/84 |
| 2009/0153859 | A1 * | 6/2009 | Kimba | 356/369 |
| 2009/0298387 | A1 * | 12/2009 | Shimizu et al. | 451/5 |
| 2010/0015889 | A1 * | 1/2010 | Shimizu et al. | 451/5 |
| 2010/0124870 | A1 | 5/2010 | Benvegnu et al. | |
| 2011/0104987 | A1 * | 5/2011 | David et al. | 451/5 |
| 2011/0275281 | A1 * | 11/2011 | David et al. | 451/5 |
| 2011/0318992 | A1 * | 12/2011 | David et al. | 451/5 |
| 2012/0021672 | A1 * | 1/2012 | David et al. | 451/6 |

* cited by examiner

*Primary Examiner* — Lee D Wilson
*Assistant Examiner* — Tyrone V Hall, Jr.
(74) *Attorney, Agent, or Firm* — Fish & Richardson P.C.

(57) ABSTRACT

A method of polishing includes polishing a substrate, making a sequence of measurements of light reflected from the substrate while the substrate is being polished, at least some of the measurements of the sequence of measurements differing due to material being removed during polishing, for each measurement in the sequence, determining a first value of a first characteristic and a second value of a different second characteristic of the light to generate a sequence of first values and second values, storing a predetermined path in a coordinate space of the first characteristic and the second characteristic, for each measurement in the sequence, determining a position on the path based on the first value and the second value, and determining at least one of a polishing endpoint or an adjustment for a polishing rate based on the position on the path.

22 Claims, 6 Drawing Sheets

ENDPOINT DETECTION USING SPECTRUM FEATURE TRAJECTORIES

TECHNICAL FIELD

The present disclosure relates to optical monitoring during processing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, it may not be possible to determine the polishing endpoint merely as a function of polishing time.

In some systems, a substrate is optically monitored in-situ during polishing, e.g., through a window in the polishing pad. However, existing optical monitoring techniques may not satisfy increasing demands of semiconductor device manufacturers.

SUMMARY

As polishing progresses, the thickness of an outermost layer is reduced, and consequently the spectrum of light from the substrate changes. Two or more characteristics of the light can be monitored. Comparing measured values of the characteristics to a predetermined path through a multi-dimensional coordinate space (defined by the two characteristics) can provide information on the current state of polishing, e.g., amount removed or amount of material remaining In one aspect, a method of polishing includes polishing a substrate, making a sequence of measurements of light reflected from the substrate while the substrate is being polished, at least some of the measurements of the sequence of measurements differing due to material being removed during polishing, for each measurement in the sequence, determining a first value of a first characteristic and a second value of a different second characteristic of the light to generate a sequence of first values and second values, storing a predetermined path in a coordinate space of the first characteristic and the second characteristic, for each measurement in the sequence, determining a position on the path based on the first value and the second value, and determining at least one of a polishing endpoint or an adjustment for a polishing rate based on the position on the path.

Implementations can include one ore more of the following features. The first characteristic may be an intensity at a first wavelength and the second value is an intensity at a different second wavelength. The first characteristic may be a ratio of an intensity at a first wavelength to an intensity at a different second wavelength, and the second value may be a ratio of an intensity at a different third wavelength to an intensity at a different fourth wavelength. The first wavelength and the second wavelength may be constant during polishing of the substrate. Making the sequence of measurements may include illuminating the substrate with a wide-band light beam that includes the first wavelength and the second wavelength. Making the sequence of measurements may include measuring a sequence of spectra, and determining the first value and the second value may include extracting the first intensity at the first wavelength in the wide-band light beam and extracting the second intensity at the second wavelength in the wide-band light beam. Making the sequence of measurements may include illuminating the substrate with a first narrow-band light beam that includes the first wavelength and illuminating the substrate with a second narrow-band light beam that includes the second wavelength. The first characteristic may be one of a location, width or intensity of a selected spectral feature and the second characteristic may be another of the location, width or intensity of the selected spectral feature. The selected spectral feature may persist with an evolving location, width or intensity through the sequence of spectra. The selected spectral feature may be a peak or a valley. Making the sequence of measurements may include measuring a sequence of spectra, and determining the first value and the second value may include extracting the one of the location, width or intensity of the spectral feature and the another of the location, width or intensity of the selected spectral feature. Determining the position on the path may include determining a closest position on the path to a coordinate in the coordinate space comprising the first value and the second value. Determining the closest position may include determining a Euclidean distance. Determining at least one of a polishing endpoint or an adjustment for a polishing rate may include determining a distance travelled along the path. Polishing may be halted when the distance travelled crosses a threshold. Storing the predetermined path may include storing a Bezier function. Determining a distance travelled along the path may include determining a T-parameter of the Bezier function for the position. Polishing may be halted when the position crosses a threshold. Storing the predetermined path may include storing a sequence of coordinates. Determining the position on the predetermined path may generate a sequence of positions on the predetermined path, and determining at least one of a polishing endpoint or an adjustment for a polishing rate may include fitting a function to the sequence of positions over time. The predetermined path may contain no degeneracies. The sequence of measurements may be from a first portion of the substrate, a second sequence of measurements of light reflected from a second portion of the substrate may be taken while the substrate is being polished. For each measurement in the second sequence, a third value of the first characteristic and a fourth value of the second characteristic may be determined, and a second position on the path may be determined based on the third value and the fourth value.

Implementations may optionally include one or more of the following advantages. Time for a semiconductor manufacturer to develop an algorithm to detect the endpoint of a particular product substrate can be reduced. Computational load for the optical monitoring can be reduced. For some materials, polishing endpoint can be determined more reliably, and wafer-to-wafer thickness non-uniformity (WTWNU) can be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

One optical monitoring technique is to measure spectra of light reflected from a substrate during polishing, and identify a matching reference spectrum from a library. One potential problem with the spectrum matching approach is that for some types of substrates there are significant substrate-to-substrate differences in underlying die features, resulting in variations in the spectra reflected from substrates that ostensibly have the same outer layer thickness. These variations increase the difficulty of proper spectrum matching and reduce reliability of the optical monitoring. Another potential problem is that, due to the large amount of data in a spectrum, finding the matching reference spectrum from the library can be computationally expensive and thus slow, and if the matching process is too slow then it will not be suitable for in-situ monitoring.

One technique that can potentially counteract these problems is to track evolution of the light from a substrate in a coordinate space having a limited number of dimensions. Values for a finite number of characteristics of the light are determined; the values define a coordinate in the coordinate space. Light from the substrate should evolve in a predictable manner, and a predicted evolution of the light can be represented by a predetermined path through the coordinate space. Progress of a polishing operation can be evaluated by comparing the coordinate calculated from the measured data to the predefined path. For example, if the coordinate is near a beginning of the path, then a significant amount of polishing remain to be performed. In contrast, if the coordinate is near an end of the path, then the polishing operation is near completion. Tracking the measured path in multiple dimensions against the predetermined path can improve accuracy of endpoint control and can allow greater uniformity in polishing between substrates within a batch or between batches.

Figure 1:
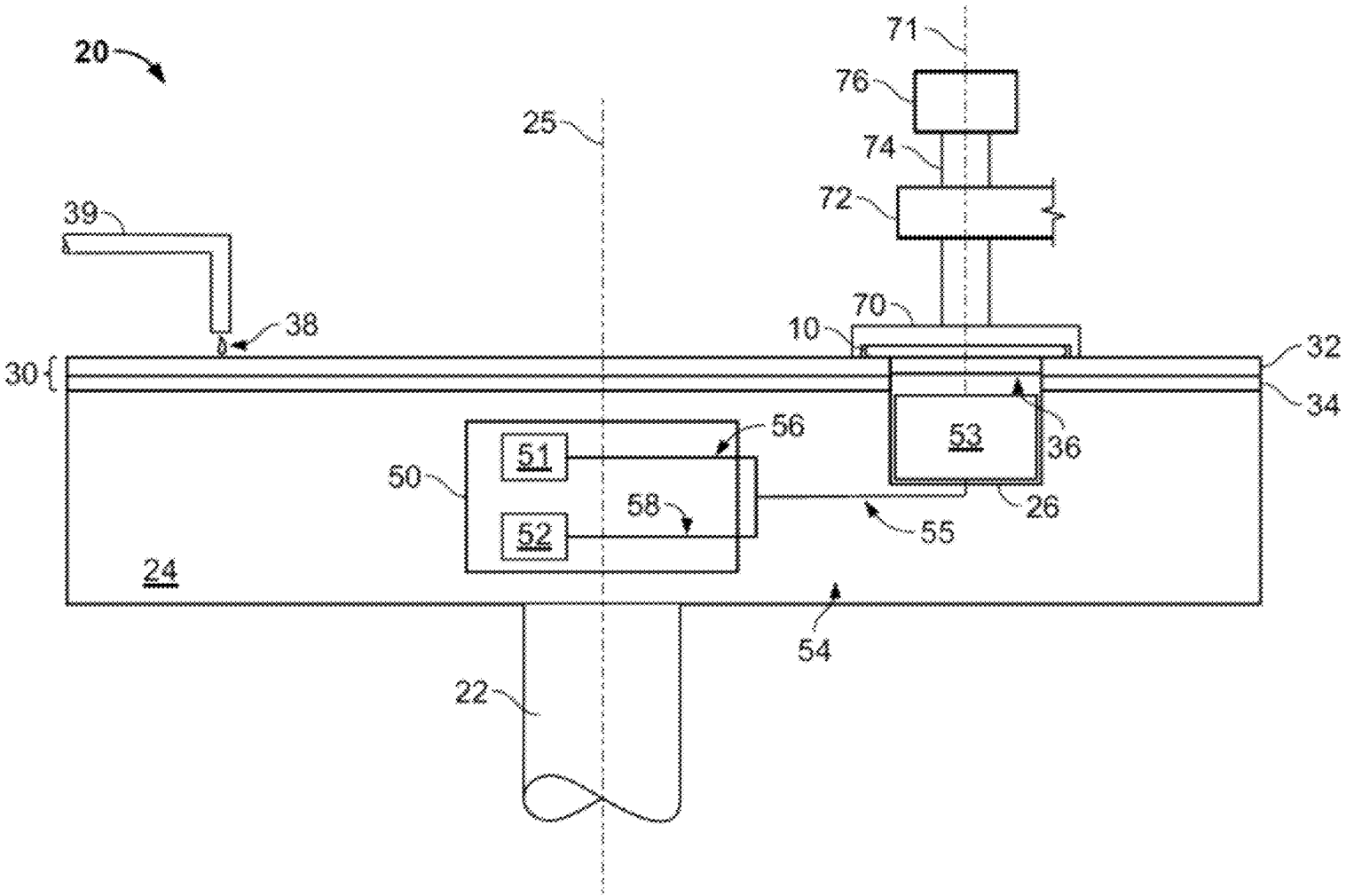
FIG. 1 shows a chemical mechanical polishing apparatus.

FIG. 1 shows a polishing apparatus 20 operable to polish a substrate 10. In this implementation, the polishing apparatus 20 includes a rotatable disk-shaped platen 24, on which a polishing pad 30 is situated. The platen is operable to rotate about axis 25. For example, a motor can turn a drive shaft 22 to rotate the platen 24. A carrier head 70 holds the substrate 10 against the polishing pad. During polishing, a polishing liquid, e.g., an abrasive slurry, can be dispensed onto the polishing pad 30.

Optical access 36 through the polishing pad is provided by including an aperture (i.e., a hole that runs through the pad) or a solid window. The solid window can be secured to the polishing pad, although in some implementations the solid window can be supported on the platen 24 and project into an aperture in the polishing pad.

The polishing apparatus also includes an optical monitoring system, which can be used to determine a polishing endpoint as discussed below. The optical monitoring system includes a light source 51 and a light detector 52. Light passes from the light source 51, through the optical access 36 in the polishing pad 30, impinges and is reflected from the substrate 10 back through the optical access 36, and travels to the light detector 52. A bifurcated optical cable 54 can be used to transmit the light from the light source 51 to the optical access 36 and back from the optical access 36 to the light detector 52.

In some implementations, the light source 51 is operable to emit white light, e.g., light having wavelengths of 200-800 nanometers. In this case, a suitable light source is a xenon lamp or a xenon-mercury lamp. In some implementations, the light source 51 is operable to emit multiple, e.g., four, narrow bands of light. In this case, a suitable light source is multiple lasers, and/or light emitting diodes, and/or a broad band light source with one or more color filters interposed in the light path. One or more of the narrow bands of light can be monochromatic, e.g., generated by a laser.

In some implementations, e.g., if the light source 51 is a white light source, the light detector 52 can be a spectrometer. A suitable spectrometer is a grating spectrometer. Typical output for a spectrometer is the intensity of the light as a function of wavelength over a portion of the electromagnetic spectrum. In some implementations, e.g., if the light source includes multiple narrow bands of light, the detector 52 can be a plurality of photodiodes tuned to detect particular wavelengths, e.g., the particular wavelengths corresponding to the multiple narrow bands. For some implementations, a spectrometer could be used the multiple narrow bands of light, or the plurality of photodiodes tuned to detect particular wavelengths could be used with a white light course. In addition, other sorts of detectors are possible, e.g., instruments that measure the polarization of the reflected light.

Figure 2:
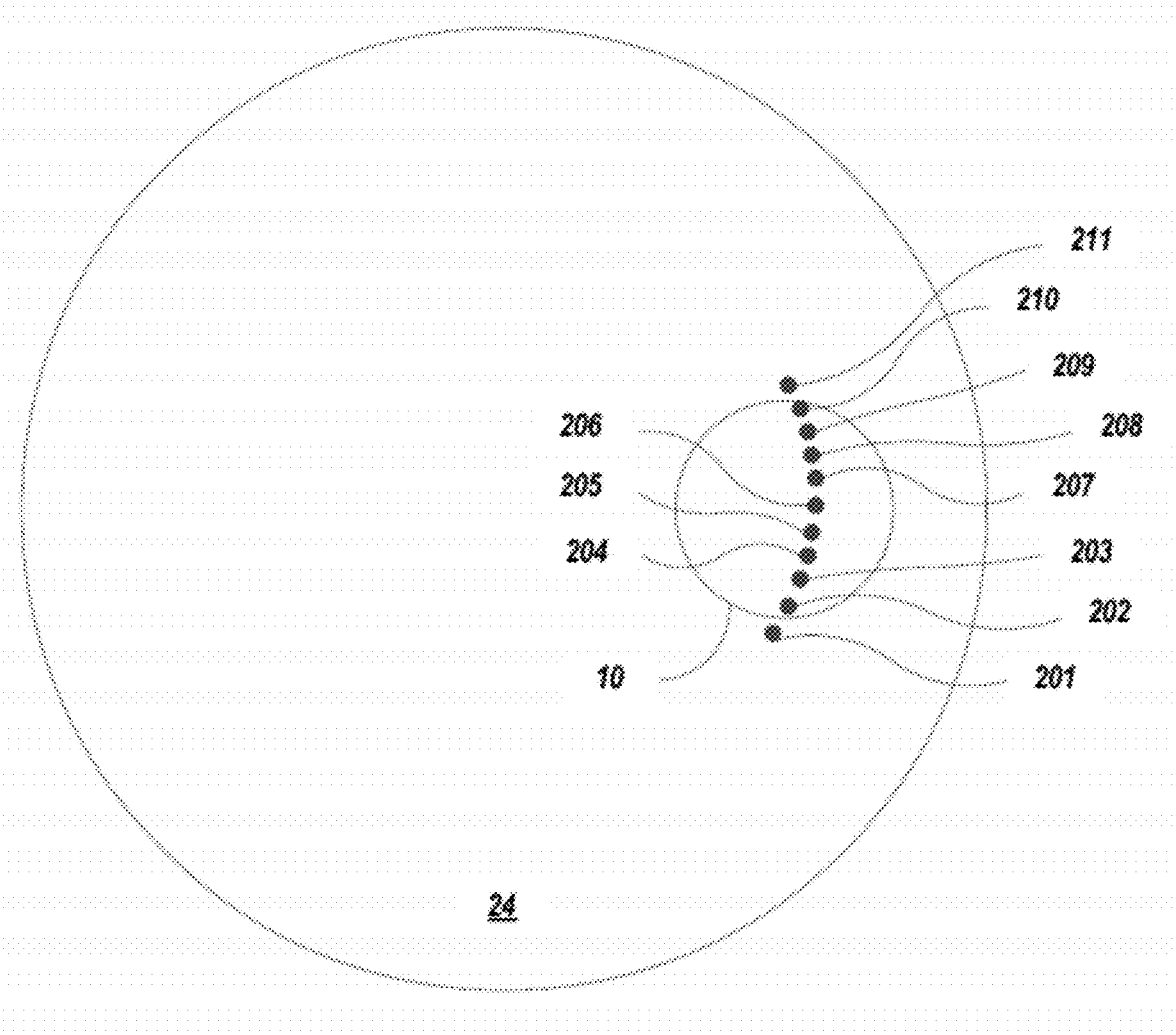
FIG. 2 is an overhead view of a polishing pad and shows locations where in-situ measurements are taken.

The light source 51 and light detector 52 are connected to a computing device 90 operable to control their operation and to receive their signals. The computing device can include a microprocessor situated near the polishing apparatus, e.g., a personal computer. With respect to control, the computing device can, for example, synchronize activation of the light source 51 with the rotation of the platen 24. As shown in FIG. 2, the computer can cause the light source 51 to emit a series of flashes starting just before and ending just after the substrate 10 passes over the in-situ monitoring module 50. Each of points 201-211 represents a location where light from the in-situ monitoring module 50 impinged upon and reflected off of the substrate 10. Alternatively, the computer can cause the light source 51 to emit light continuously starting just before and ending just after the substrate 10 passes over the in-situ monitoring module 50.

The measurements obtained as polishing progresses, e.g., from successive sweeps of the sensor in the platen across the substrate, provide a sequence of measurements, e.g., one measurement per sweep of the sensor. Assuming that a spectrometer is used, the spectra obtained as polishing progresses provides a sequence of spectra, e.g., one spectrum per sweep of the sensor.

Figure 3:
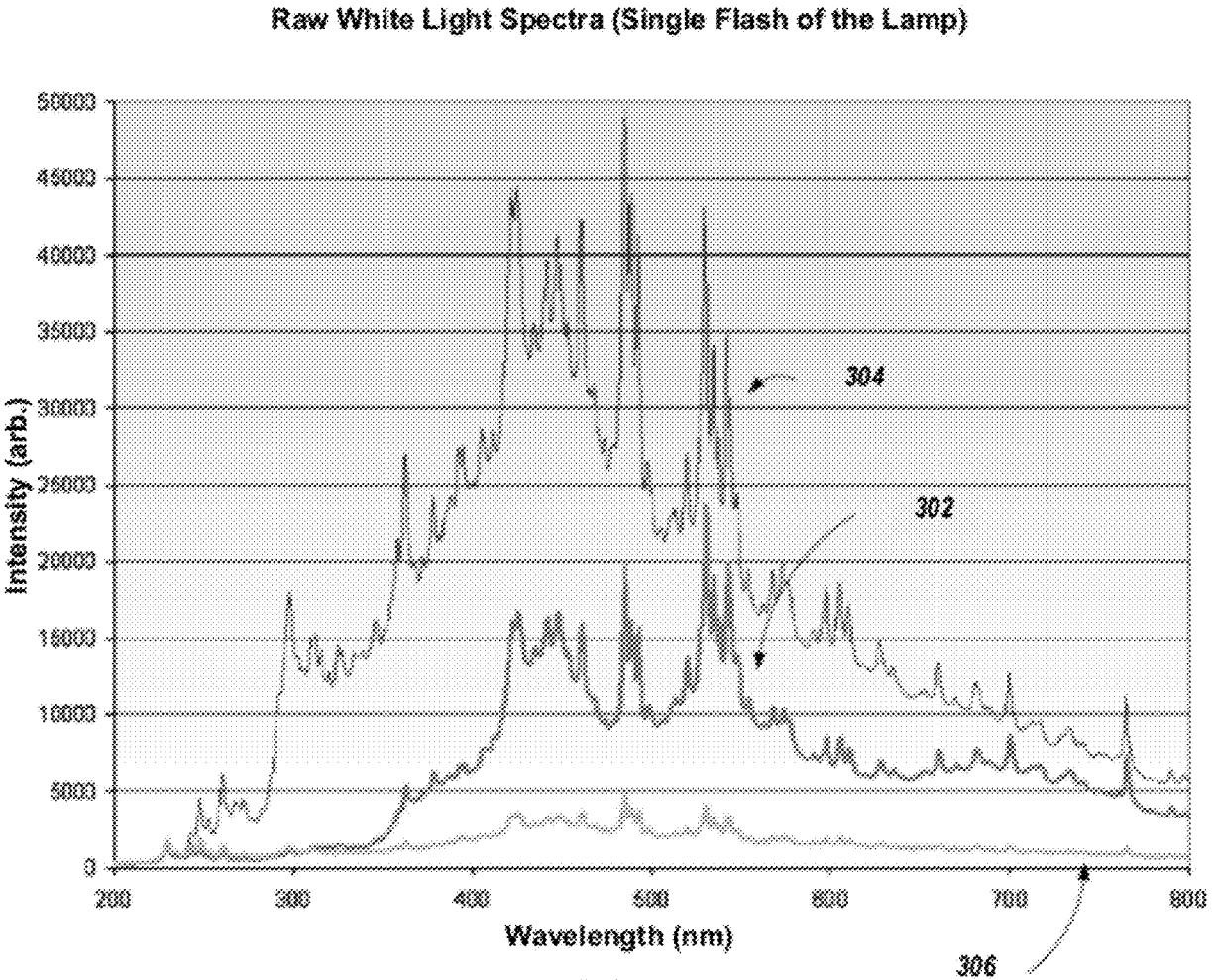
FIG. 3 shows a spectrum obtained from an in-situ measurement.

FIG. 3 provides an example of a measured spectrum 300 of light reflected from the substrate 10. The optical monitoring system can pass the measured spectrum 300 through a high-pass filter in order to reduce the overall slope of the spectrum, and/or through a low-pass filter to remove noise. In addition, the measured spectrum can be normalized or subject to other preprocessing steps, e.g., the measured spectrum can be divided by a predetermined spectrum, e.g., of a blank wafer, or a predetermined spectrum can be subtracted from the measured spectrum.

Without being limited to any particular theory, the spectrum of light reflected from the substrate 10 evolves as polishing progresses. The properties of the spectrum of the reflected light change as a thickness of the film changes. Ideally, a particular spectrum is exhibited by a particular thicknesses of the film. Although an individual spectrum is fairly complex, it may be possible to monitor the evolution of a spectrum using a limited set of characteristics.

Figure 4:
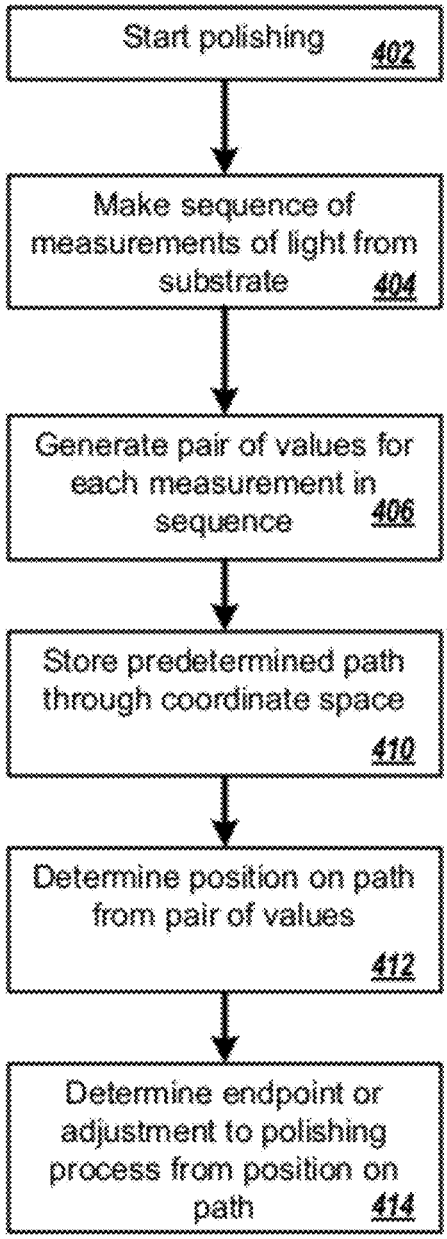
FIG. 4 shows a method for endpoint determination.

FIG. 4 illustrates a method of determining a polishing endpoint. A substrate is polished (step 402). A sequence of measurements of light reflected from the substrate is made while the substrate is being polished (step 404). At least some of the measurements of the sequence of measurements differ due to material being removed during polishing.

For each measurement in the sequence, a pair of values is generated (step 406) to create a sequence of pairs of values. Each pair of values includes a first value of a first characteristic and a second value of a different second characteristic of the light. Thus, the sequence pairs of values includes a first sequence of the first values and a second sequence of the second values. Each pair of values will define a coordinate in the coordinate space, as discussed further below.

The first and second characteristics can be selected prior to the beginning of polishing. In some implementations, the computer system receives an identification of the first and second of characteristics, e.g., from user input by the user of the polishing apparatus, e.g., the semiconductor fab.

In some implementations, the first value and the second value are derived from a measured spectrum. In some implementations, the first value and the second value are derived from measurements of light intensity at a small number, e.g., four, of discrete wavelengths. In some implementations, the first value and the second value are measured directly by the sensor of the in-situ monitoring system.

In some implementations, the first characteristic is a ratio of intensity at a first wavelength to an intensity at a second wavelength, and the second characteristic is a ratio of intensity at a third wavelength to intensity at a fourth wavelength.

Figure 5:
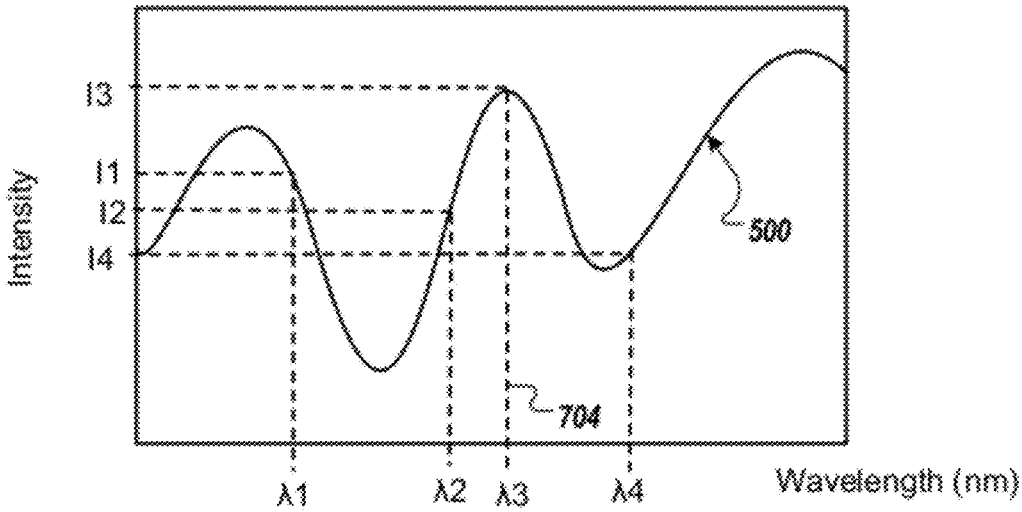
FIG. 5 shows an example graph of a spectrum of light reflected from a substrate.

For example, referring to FIG. 5, the intensity (shown by spectrum 500) of the reflected light can be measured at four different wavelengths, $\lambda_1$, $\lambda_2$, $\lambda_3$ and $\lambda_4$ (the first, second, third and fourth wavelength) to generate four intensity measurements $I_1$, $I_2$, $I_3$ and $I_4$. A first value $V_1$ for the first characteristic can be calculated as $I_1/I_2$, and a second value $V_2$ for the second characteristic can be calculated as $I_3/I_4$.

The intensity measurements can be obtained by measuring the spectrum 500 of the reflected light and extracting the intensities at the four wavelengths from the spectrum. Alternatively, the intensities can be measured by directing the reflected light onto four photodetectors that are tuned to the four wavelengths, respectively. Alternatively, the intensities can be measured by splitting the reflected light into four beams, passing the beams through four filters corresponding to the four wavelengths, and onto four photodetectors. In addition, although FIG. 5 shows a spectrum that would be generated by reflection of light from a white light source, the light source need only provide illumination at the four wavelengths $\lambda_1$, $\lambda_2$, $\lambda_3$ and $\lambda_4$, e.g., the light source could be four lasers or LEDs that generate light with narrow bandwidths at $\lambda_1$, $\lambda_2$, $\lambda_3$ and $\lambda_4$.

In some implementations, the first characteristic is a location (in terms of wavelength or frequency) of a spectral feature, and the second characteristic is an intensity or width (the later again in terms of wavelength or frequency) of the spectral feature. Examples of spectral features include spectral peaks and valleys. The location of a spectral feature can be calculated as the location of the maximum value (of the peak) or minimum value (for a valley), of middle of the spectral feature (e.g., by determining the edges of the feature and calculating a midpoint), or of a median of the spectral feature (e.g., a weighted average of locations between the edges of the feature with weighting determined by the intensity at the location).

Figure 6:
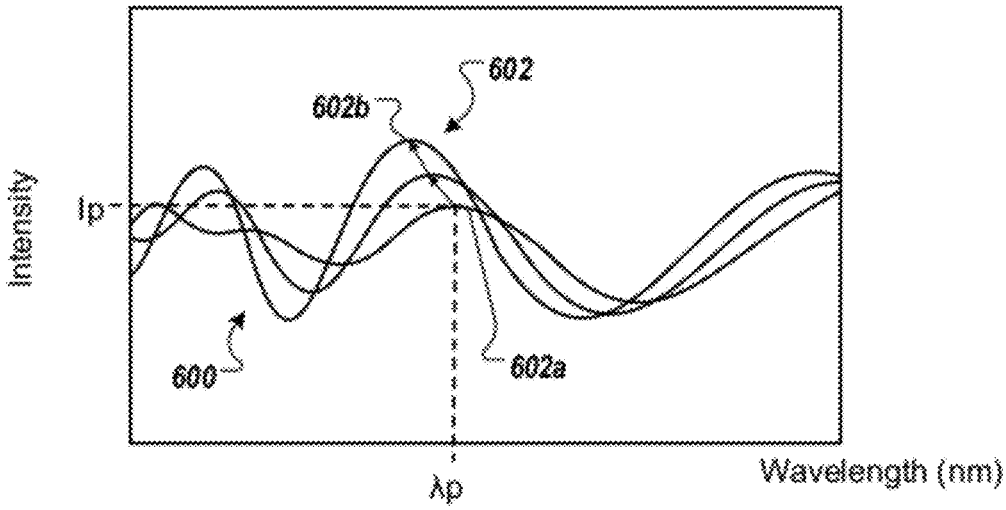
FIG. 6 illustrates evolution of a spectrum of light reflected from a substrate.

For example, FIG. 6 illustrates the evolution of a spectrum 600 as polishing progresses. Some features, e.g., some peaks and valleys, persist through evolution of the spectrum. For example, the peak 602 illustrates a peak 602*a* in the spectrum at a certain time during polishing, and peak 602*b* illustrates the same peak 602 at a later time. Peak 602*a* is located at a longer wavelength, has a lower intensity, and is wider than peak 604*b*. At any particular time, a first value $V_1$ for the first characteristic can be calculated as the wavelength position $\lambda_P$ of the peak 602, and a second value $V_2$ for the second characteristic can be calculated as the intensity $I_P$ of the peak 602 or width of the peak 602 (FIG. 6 illustrates the values being determined for peak 602*a*).

Figure 7:
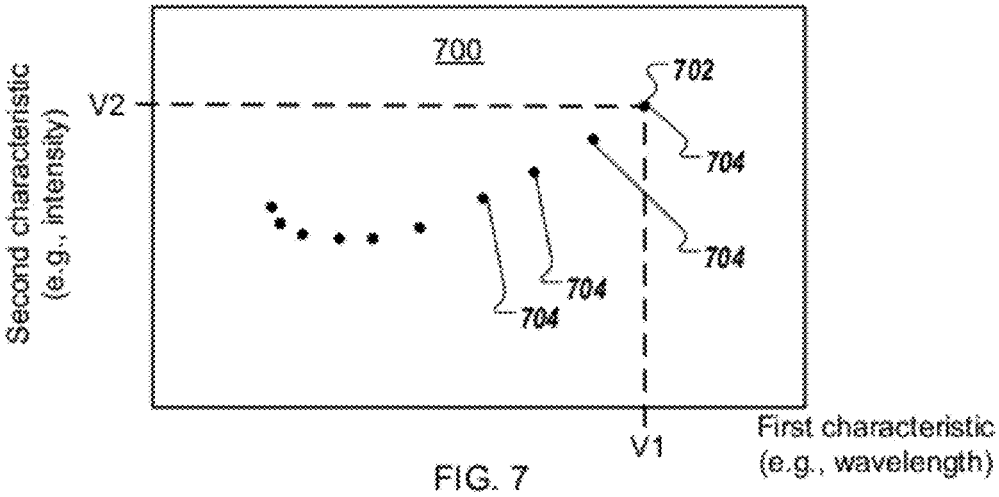
FIG. 7 shows an example graph of a sequence of coordinates in a multi-dimensional space.

As noted above, each pair of values can define a coordinate in a coordinate space of the first characteristic and the second characteristic. Referring to FIG. 7, for example, when polishing begins, the pair of values V1, V2 defines an initial coordinate 702. However, because the reflected light changes as polishing progresses, the measured values of characteristics change, and consequently the location of the coordinate will change as polishing progresses. The sequence of pairs of values define a sequence of coordinates 704 in the coordinate space.

Figure 8:
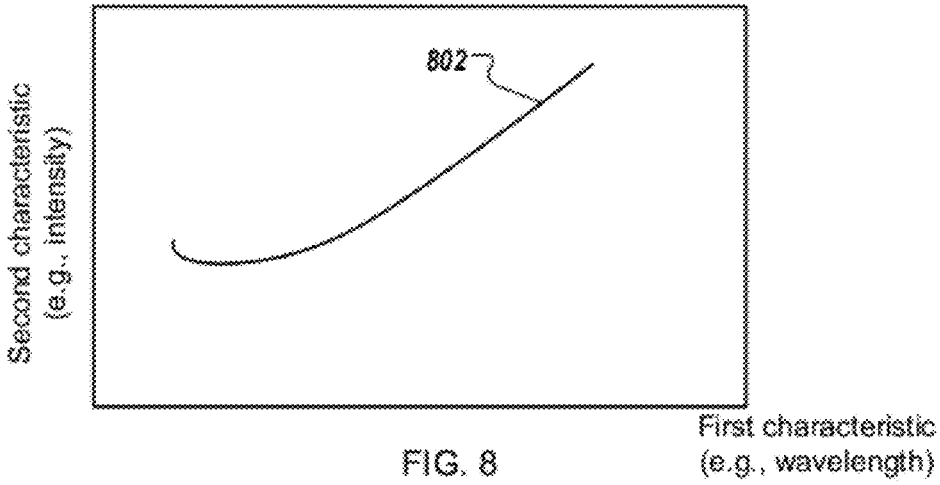
FIG. 8 shows an example graph of a predetermined path through the multi-dimensional space.

Referring to FIG. 8, a predetermined path 802 in the coordinate space of the first characteristic and the second characteristic is stored (step 410), e.g., in a memory of the computer 90. The predetermined path is generated prior to polishing of the substrate that will be the source of measurements that generate the sequence of measurements.

In some implementations, to determine the predetermined path, a set-up substrate is polished and monitored, e.g., using the optical monitoring system 50, to provide a sequence of coordinates for the set-up substrate. In some implementations, a set of curves, e.g., Bezier functions, can be fit manually or automatically to the sequence of coordinates. In some implementations, local gradients in the data are detected to generate a series of vectors.

By proper selection of the first and second characteristics, the predetermined path will not contain degeneracies. However, even if the predetermined path contains degeneracies, it may still be possible to reliably determine a position along the path, e.g., by incorporating the direction of motion of the measured values into the determination of the position on the path.

Figure 9:
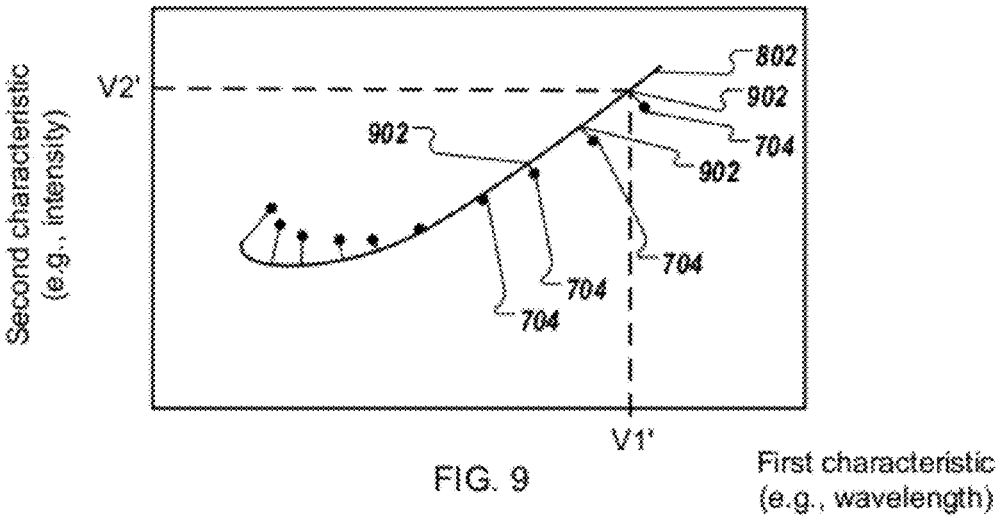
FIG. 9 shows an example graph of a sequence of positions on the predetermined path through the multi-dimensional space determined based on the sequence of coordinates.

Referring to FIG. 9, for each coordinate 704 (e.g., for each measurement in the sequence), a position 902 on the path 802 is determined based on the first value and the second value of the coordinate 704 (step 412). The position on the path can be the closest position on the path, e.g., the position with the minimum Euclidean distance in the coordinate space (alternatively, distance could be measured as the sum of the absolute values of the differences in each coordinate axis). This generates a sequence of positions 902 on the path 802. Each positions 902 on the path has a corresponding pair of values V1', V2'.

The polishing endpoint can be determined based on the position on the path (step 414). As one example, polishing can be halted when the position reaches a predetermined position on the path. As another example, a distance travelled along the path can be determined, and polishing can be halted when a predetermined distance has been travelled. In some implementations, determining a distance travelled along the path comprises determining a T-parameter of the Bezier function for the position on the path. In some implementation, a distance travelled along the path is determined for each measurement to generate a sequence of distances travelled, and a function of time, e.g., a linear function, is fit to the sequence of distances travelled along the path, and a projection of the linear function to a target value or a value of the projection at a target time is used to determine the endpoint or adjustment to the polishing rate.

Instead of or in addition to detecting the polishing endpoint, the movement of the position on the path in the two-dimensional space can be used to adjust a polishing rate in one of the zones of the substrate in order to reduce within-wafer non-uniformity (WIWNU). In particular, multiple sequences of spectra of light may be from different portions of the substrate, e.g., from a first portion and a second portion. The location and associated intensity value of the selected spectral feature in the respective sequences of spectra for the different portions can be measured to generate a multiple sequences of coordinates, e.g., a first sequence for the first portion and a second sequence for a second portion of the substrate. For each sequence of coordinates, a position on the path or distance travelled along the path can be determined using one of the techniques described above. The first distance can be compared to the second distance to determine an adjustment for the polishing rate. In particular, the polishing pressures on different regions of the substrate can be adjusted using the techniques described above, but substituting the calculated distances for the difference values.

In some implementations, the polishing apparatus 20 identifies multiple spectra for each platen revolution and averages the spectra taken during a current revolution in order to determine the two current characteristic values associated with an identified spectral feature. In some implementations, after a predetermined number of spectra measurements, the spectra measurements are averaged to determine the current characteristic values. In some implementations, median characteristic values or median spectra measurements from a sequence of spectra measurements are used to determine the current characteristic values. In some implementations, spectra that are determined to not be relevant are discarded before determining the current characteristic values.

The discussion above focuses on generating a pair of values for each spectrum in the sequence of spectra, so the pair of values represents a coordinate in a two-dimensional space. However, more than two values could be generated, with a corresponding path through a coordinate space having more than two dimensions. For example, a tuple of values could be generated for each spectrum in the sequence of spectra. In the case of a tuple, a third value of a third characteristic, different from the first characteristic and the second characteristic, would be generated, and the tuple can represent a coordinate in a three-dimensional space. The sequence of coordinated in the three-dimensional space can be compared to a predetermined path in the three-dimensional space using the same principles of the discussion above.

Some polishing operations can remove multiple layers. For example, some polishing operations are intended to completely remove an upper layer, e.g., a barrier layer, and then remove a portion of the thickness of an underlying layer, e.g., a low-k dielectric. However, where multiple layers of similar optical properties, e.g., dielectric layers, are stacked, determining the transition from the upper layer to the underlying layer can be difficult. This can pose a problem, e.g., where the desired endpoint condition is removal of a certain thickness of the underlying layer. However, this problem can be reduced if the tracking of the measured path to the predefined path is triggered by another monitoring technique, e.g., sensing changes in friction or motor torque, that can reliably detect removal of the upper layer and exposure of the underlying layer. Thus, the beginning of the measured path will reliably coincide with the commencement of polishing of the underlying layer.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in an information carrier, e.g., in a machine-readable storage device or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier head, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A method of polishing, comprising:

polishing a substrate;

making a sequence of measurements of light reflected from the substrate while the substrate is being polished, at least some of the measurements of the sequence of measurements differing due to material being removed during polishing;

for each measurement in the sequence, determining a first value of a first characteristic and a second value of a different second characteristic of the light to generate a sequence of first values and second values;

storing a predetermined path in a coordinate space of the first characteristic and the second characteristic;

for each measurement in the sequence, determining a position on the predetermined path based on the first value and the second value; and determining at least one of a polishing endpoint or an adjustment for a polishing rate based on the position on the path.

2. The method of claim 1, wherein the first characteristic is an intensity at a first wavelength and the second characteristic is an intensity at a different second wavelength.

3. The method of claim 1, wherein the first characteristic is a ratio of an intensity at a first wavelength to an intensity at a different second wavelength, and the second characteristic is a ratio of an intensity at a different third wavelength to an intensity at a different fourth wavelength.

4. The method of claim 3, wherein the first wavelength and the second wavelength are constant during polishing of the substrate.

5. The method of claim 3, wherein making the sequence of measurements comprises illuminating the substrate with a wide-band light beam that includes the first wavelength and the second wavelength.

6. The method of claim 5, wherein making the sequence of measurements comprises measuring a sequence of spectra, and wherein determining the first value and the second value comprises extracting the first intensity at the first wavelength in the wide-band light beam and extracting the second intensity at the second wavelength in the wide-band light beam.

7. The method of claim 2, wherein making the sequence of measurements comprises illuminating the substrate with a first narrow-band light beam that includes the first wavelength and illuminating the substrate with a second narrow-band light beam that includes the second wavelength.

8. The method of claim 1, wherein the first characteristic is one of a location, width or intensity of a selected spectral feature and the second characteristic is another of the location, width or intensity of the selected spectral feature.

9. The method of claim 8, wherein the selected spectral feature persists with an evolving location, width or intensity through the sequence of spectra.

10. The method of claim 9, wherein the selected spectral feature comprises a peak or a valley.

11. The method of claim 8, wherein making the sequence of measurements comprises measuring a sequence of spectra, and wherein determining the first value and the second value comprises extracting the one of the location, width or intensity of the spectral feature and the another of the location, width or intensity of the selected spectral feature.

12. The method of claim 1, wherein determining the position on the path comprises determining a closest position on the path to a coordinate in the coordinate space comprising the first value and the second value.

13. The method of claim 12, wherein determining the closest position comprises determining a Euclidean distance.

14. The method of claim 1, wherein determining at least one of the polishing endpoint or the adjustment for the polishing rate comprises determining a distance travelled along the path.

15. The method of claim 14, further comprising halting polishing when the distance crosses a threshold.

16. The method of claim 14, wherein storing the predetermined path comprises storing a Bezier function, and determining the distance travelled along the path comprises determining a T-parameter of the Bezier function for the position.

17. The method of claim 1, further comprising halting polishing when the position crosses a threshold.

18. The method of claim 1, wherein storing the predetermined path comprises storing a Bezier function.

19. The method of claim 1, wherein storing the predetermined path comprises storing a sequence of coordinates.

20. The method of claim 1, wherein determining the position on the predetermined path generates a sequence of positions on the predetermined path, and wherein determining at least one of the polishing endpoint or the adjustment for the polishing rate comprises fitting a function to the sequence of positions over time.

21. The method of claim 1, wherein the predetermined path contains no degeneracies.

22. The method of claim 21, wherein the sequence of measurements is from a first portion of the substrate, and further comprising taking a second sequence of measurements of light reflected from a second portion of the substrate while the substrate is being polished, for each measurement in the second sequence, determining a third value of the first characteristic and a fourth value of the second characteristic and determining a second position on the path based on the third value and the fourth value.

* * * * *